US009495951B2

(12) United States Patent
Miet et al.

(10) Patent No.: US 9,495,951 B2
(45) Date of Patent: Nov. 15, 2016

(54) REAL TIME AUDIO ECHO AND BACKGROUND NOISE REDUCTION FOR A MOBILE DEVICE

(71) Applicant: Nvidia Corporation, Santa Clara, CA (US)

(72) Inventors: Gilles Miet, Sophia Antipolis (FR); Stefano Sarghini, Sophia Antipolis (FR); Nigel Paton, Cambridge (GB)

(73) Assignee: Nvidia Corporation, Santa Clara, CA (US)

( * ) Notice: Subject to any disclaimer, the term of this patent is extended or adjusted under 35 U.S.C. 154(b) by 139 days.

(21) Appl. No.: 14/033,999

(22) Filed: Sep. 23, 2013

(65) Prior Publication Data

US 2014/0198923 A1 Jul. 17, 2014

Related U.S. Application Data

(60) Provisional application No. 61/753,760, filed on Jan. 17, 2013.

(51) Int. Cl.
*H04R 29/00* (2006.01)
*G10K 11/178* (2006.01)

(52) U.S. Cl.
CPC ..... *G10K 11/178* (2013.01); *G10K 2210/1081* (2013.01); *G10K 2210/505* (2013.01); *H04R 29/00* (2013.01); *H04R 29/004* (2013.01); *H04R 29/008* (2013.01)

(58) Field of Classification Search
CPC ..... H04R 5/02; H04R 5/023; H04R 29/00; H04R 29/004; H04R 29/008; G10K 2210/505
USPC ..... 381/66, 94.1–94.9, 95–96, 83, 93, 56, 381/58–60; 704/226, 233
See application file for complete search history.

(56) References Cited

U.S. PATENT DOCUMENTS

| | | | | |
|---|---|---|---|---|
| 5,213,108 | A * | 5/1993 | Bredesen et al. | 600/528 |
| 7,627,111 | B2 | 12/2009 | Bershad et al. | |
| 8,379,879 | B2 | 2/2013 | Chang et al. | |
| 8,577,675 | B2 | 11/2013 | Jelinek | |
| 8,731,207 | B2 | 5/2014 | Kuech et al. | |
| 2003/0064746 | A1* | 4/2003 | Rader | H04R 25/70 455/550.1 |
| 2009/0180631 | A1* | 7/2009 | Michael | H04R 29/008 381/58 |
| 2009/0304193 | A1* | 12/2009 | Hamilton | H04R 29/008 381/59 |
| 2010/0166199 | A1* | 7/2010 | Seydoux | H04M 9/082 381/66 |
| 2011/0064232 | A1* | 3/2011 | Ruwisch | H04M 1/24 381/59 |
| 2011/0066941 | A1 | 3/2011 | Chipchase et al. | |
| 2011/0166856 | A1 | 7/2011 | Lindahl et al. | |
| 2011/0289410 | A1 | 11/2011 | Paczkowski et al. | |
| 2012/0230502 | A1* | 9/2012 | Nishizaki | H04R 25/70 381/60 |

FOREIGN PATENT DOCUMENTS

| | | | |
|---|---|---|---|
| CN | 101953145 | A | 1/2011 |
| TW | I234941 | B | 6/2005 |
| TW | I279776 | B | 4/2007 |
| TW | M337201 | U | 7/2008 |
| TW | I381370 | B | 1/2013 |

* cited by examiner

*Primary Examiner* — Disler Paul

(57) ABSTRACT

An audio enhancement system includes a display unit configured to exhibit a waveform corresponding to a microphone signal that is subject to an audio interference. The audio enhancement system also includes an interference reduction unit coupled to the microphone signal and configured to provide a reduction in the audio interference, wherein a reduced audio interference is indicated by the waveform in real time. A microphone signal enhancement method is also provided.

20 Claims, 8 Drawing Sheets

REAL TIME AUDIO ECHO AND BACKGROUND NOISE REDUCTION FOR A MOBILE DEVICE

CROSS-REFERENCE TO RELATED APPLICATION

This application claims the benefit of U.S. Provisional Application Ser. No. 61/753,760, filed by Gilles Miet, Stefano Sarghini and Nigel Paton on Jan. 17, 2013, entitled "Audio Real Time Tuning and Debug Tool", commonly assigned with this application and incorporated herein by reference.

TECHNICAL FIELD

This application is directed, in general, to echo and background noise cancellation and, more specifically, to an audio enhancement system and a microphone signal enhancement method.

BACKGROUND

As mobile devices become more popular, they are increasingly used in noisy environments such as airports, outdoor street and traffic situations or restaurants, for example. Acoustic noise suppression addresses background noise sources that are essentially independent of informational audio signals created by the mobile devices themselves, but decrease the signal to noise ratio of these independent informational audio signals and therefore need to be reduced or eliminated. Acoustic echo cancelling primarily addresses acoustic echoes of the independent informational audio signals that occur due to acoustic reflections in a user environment or occur due to the close proximity of a mobile device's speaker and its accompanying microphone.

These environments make it difficult to be correctly heard or understood over a communications link. Additionally, many communication systems increasingly rely on computer voice commands or audio recognition to operate properly. High levels of background acoustic interference can cause high error rates in these types of systems. A mobile device that is moving with respect to background noise sources or audio reflectors offers added complexity to proper operation in these environments. Therefore, an enhanced capability, especially of mobile devices, to compensate for these environments would prove beneficial to the art.

SUMMARY

Embodiments of the present disclosure provide an audio enhancement system and a microphone enhancement method.

In one embodiment, the audio enhancement system includes a display unit configured to exhibit a waveform corresponding to a microphone signal that is subject to an audio interference. The audio enhancement system also includes an interference reduction unit coupled to the microphone signal and configured to provide a reduction in the audio interference, wherein a reduced audio interference is indicated by the waveform in real time.

In another aspect, an embodiment of the microphone enhancement method includes displaying a waveform corresponding to a microphone signal that is subject to an audio interference and providing a reduction in the audio interference of the microphone signal, wherein a reduced audio interference is indicated by the waveform in real time.

The foregoing has outlined preferred and alternative features of the present disclosure so that those skilled in the art may better understand the detailed description of the disclosure that follows. Additional features of the disclosure will be described hereinafter that form the subject of the claims of the disclosure. Those skilled in the art will appreciate that they can readily use the disclosed conception and specific embodiment as a basis for designing or modifying other structures for carrying out the same purposes of the present disclosure.

BRIEF DESCRIPTION

Reference is now made to the following descriptions taken in conjunction with the accompanying drawings, in which.

DETAILED DESCRIPTION

Embodiments of the present disclosure provide a graphical approach to alter, adjust or tune acoustic echo cancellation and background noise suppression, which may be especially beneficial in mobile devices. Generally, real time correction or analysis is employed to enhance audio quality related issues wherein energy is altered.

For purposes of this disclosure, the term "real time" as employed in echo cancellation or noise suppression is defined as a time short enough to experience an improvement in the audio quality for an existing or ongoing communication. Additionally, a mobile device is defined as any portable electronic unit having a display and employing a microphone and a speaker for communication of audio signals.

Figure 1:
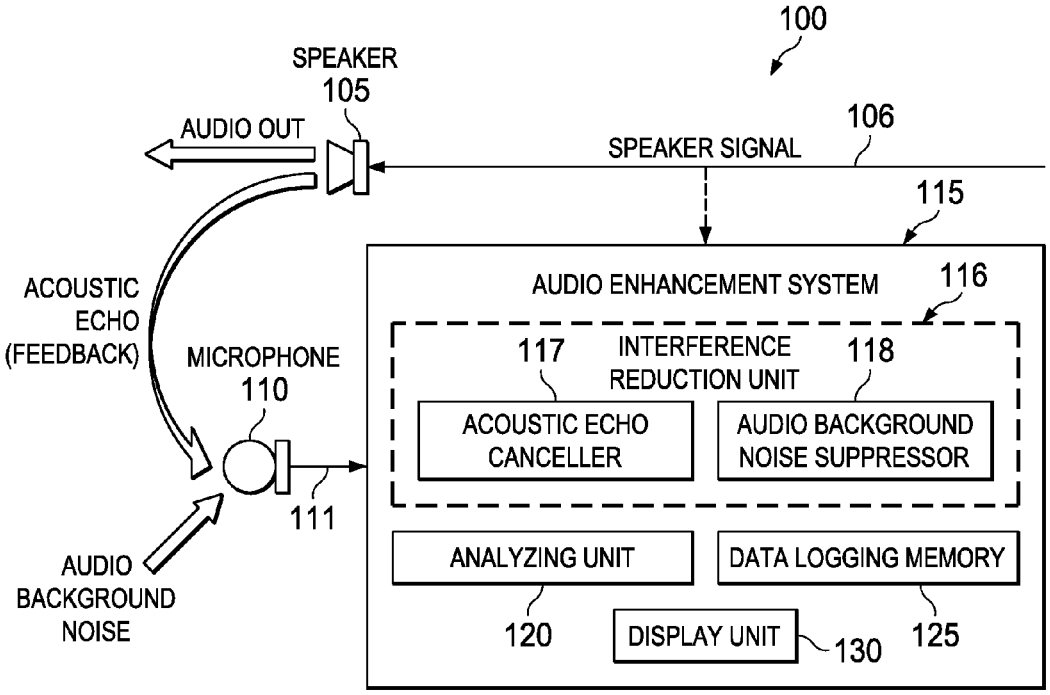
FIG. 1 illustrates a block diagram of a portion of a communications arrangement constructed according to the principles of the present disclosure.

FIG. 1 illustrates a block diagram of a portion of a communications arrangement, generally designated 100, constructed according to the principles of the present disclosure. The portion of the communications arrangement 100 includes a speaker 105, a microphone 110 and an audio enhancement system 115. The audio enhancement system 115 includes an interference reduction unit 116 having an acoustic echo canceller 117 and an audio background noise suppressor 118 that are coupled to an analyzing unit 120. The audio enhancement system 115 also includes a data logging memory 125 and a display unit 130. The acoustic echo canceller 117, the audio background noise suppressor 118 and the analyzing unit 120 provide and verify audio quality enhancement in real time.

Generally, the display unit 130 is configured to exhibit a waveform corresponding to a microphone signal 111 that is subject to an audio interference. This audio interference typically consists of acoustic echo feedback originating from the speaker 105 and audio background noise originating from a user site environment. The interference reduction unit 116 is coupled to the microphone signal 111 and may be coupled to an input speaker signal 106 to provide a reduction in the audio interference, wherein a reduced audio interference is indicated by the waveform in real time.

In the illustrated embodiment, the audio background noise suppressor 118 is coupled to the acoustic echo canceller 117 and is configured to reduce background noise in real time after achieving a preselected degree of echo cancellation of the acoustic echo signal. Generally, the order of the processing blocks (echo cancellation and noise suppression) depends on an algorithm design choice. Here, the processing order shown is exemplary, and any processing order is acceptable based on the principles of the present disclosure.

The speaker 105 provides an audio output proportional to the input speaker signal 106. An unintended portion of this audio output from the speaker 105 is fed back to the microphone 110 as an acoustic echo, wherein it is further provided as an electrical input in the microphone signal 111 to the acoustic echo canceller 117 for acoustic echo signal reduction. In one embodiment, the acoustic echo canceller 117 employs a normalized least mean square (NLMS) filter structure or algorithm to reduce the acoustic echo to an acceptable or preselected degree of echo cancellation. Correspondingly, the analyzing unit 120 may provide an estimated echo impulse response indication.

Additionally, an echo cancelling or audio noise suppression algorithm may be self-adaptive to achieve a preselected degree audio interference reduction. In one case, the input speaker signal 106 may be employed as a reference input to the acoustic echo canceller 117. In another case, an echo cancelling algorithm may include an adaptive echo delay estimate to provide the degree of echo cancellation. Alternately, an echo cancelling or audio background noise suppressing algorithm may be user-directed to achieve a preselected degree of cancellation or suppression, wherein user-directed attention (AT) commands may be used to modify appropriate parameters, for example.

The data logging memory 125 is employed to retain echo and background noise data during echo cancellation and noise suppression as well as data for future analysis or testing (e.g., echo or noise algorithm testing). The echo and background noise data may correspond to logged samples of a waveform that are retained in the data logging memory 125 for additional analysis. The additional analysis may include display, play-back or conversion of an audio file.

In the illustrated embodiment, after a required or preselected degree of echo cancellation is achieved by the acoustic echo canceller 117, its output signal allows the audio background noise suppressor 118 to provide noise suppression of a remaining background noise. The remaining background noise typically may include energy altered signals such as clicks, pops or other similar interfering noises as well as other environmental noises that may be related to wind, airplane, train, car or crowds, for example. Generally, respective inputs 106, 111 and outputs from the acoustic echo canceller 117, the audio background noise suppressor 118, the analyzing unit 120 and the data logging memory 125 are available for observation on the display unit 130.

Figure 2A:
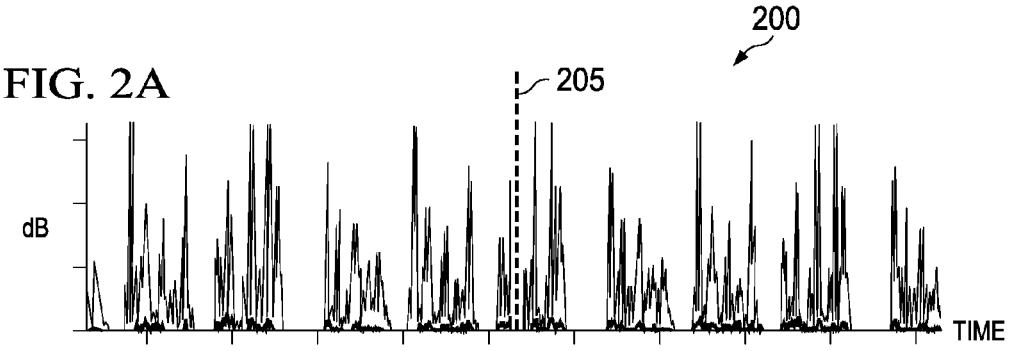
FIGS. 2A, 2B and 2C illustrate waveform examples corresponding to an acoustic echo cancellation, as discussed with respect to FIG. 1.
Figure 2B:
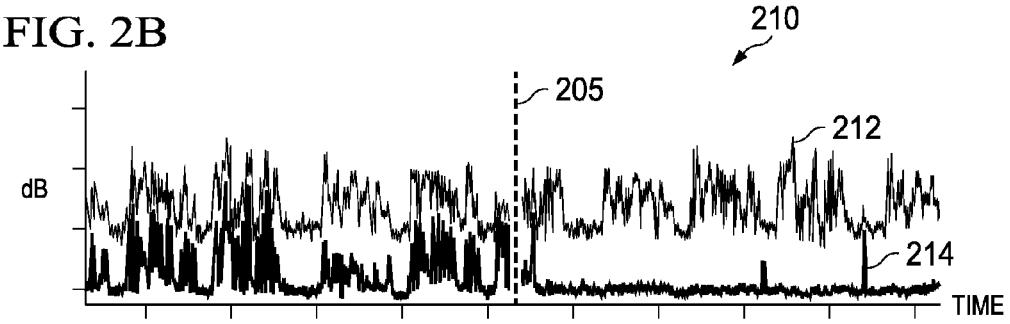
Figure 2C:
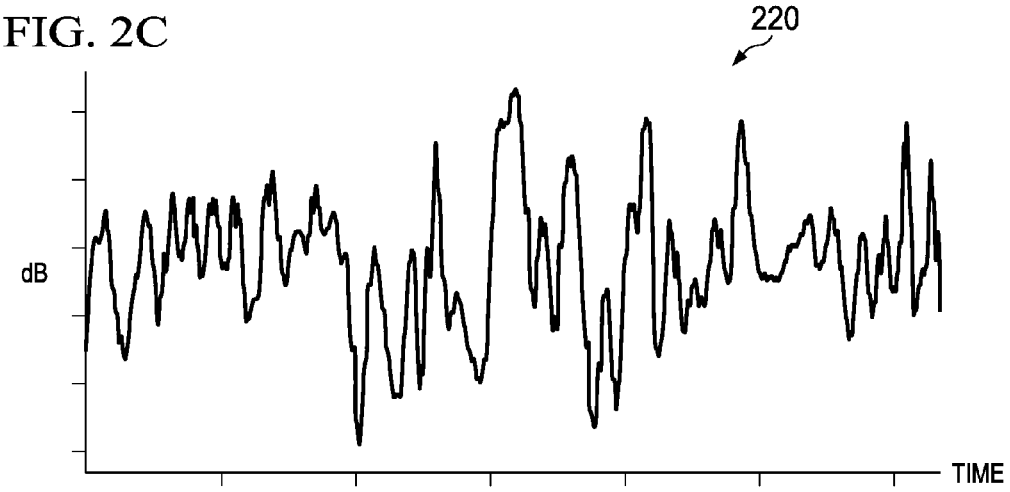

FIGS. 2A, 2B and 2C illustrate waveform examples, generally designated 200, 210, 220, corresponding to an acoustic echo cancellation, as discussed with respect to FIG. 1. Here, an observation time 205 is noted that may correspond to an initial echo cancellation filter or algorithm setting in the acoustic echo canceller 117, for example. In the examples of FIGS. 2A, 2B and 2C, this initial echo cancellation algorithm or filter setting provides an unacceptable degree of echo cancellation.

The waveform 200 corresponds to a speaker waveform as may be applied to the speaker 105 of FIG. 1. The waveforms 210 contain two component waveforms. A first component waveform 212 corresponds to an audio echo waveform initiated by the speaker 105 and fed back to the microphone 110 thereby providing the input 111 to the acoustic echo canceller 117. The first component waveform 212 indicates that echo coupling from the speaker 105 to the microphone 110 is substantial. Additionally, the first component waveform 212 also indicates that a microphone signal strength is not sufficient to cause clipping of the first component waveform 212, thereby avoiding unwanted signal distortion. The first component waveform 212 additionally indicates that the microphone signal strength is sufficient to provide for its proper processing.

A second component waveform 214 corresponds to an output of the acoustic echo canceller 117 based on the acoustic echo signal provided to its input at the echo cancellation observation time 205. As may be seen, the output of the acoustic echo canceller 117 (i.e., the second component waveform 214) indicates that a large percentage of acoustic echo energy is still contained in the output of the acoustic echo canceller 117.

The waveform 220 corresponds to a resulting echo cancellation signature, as may be supplied by the analyzing unit 120 of FIG. 1. Here, the waveform 220 corresponds to a coefficients snapshot of an echo cancellation filter or algorithm being employed by the acoustic echo canceller 117. This waveform 220 typically provides an estimated echo impulse response. Although not specifically shown, the waveform 220 may also correspond to a coefficients summation of the echo cancellation filter or algorithm employed by the acoustic echo canceller 117, which would additionally indicate a level of output acoustic echo energy still existing.

The waveform 220 also indicates how well an applied echo cancellation algorithm in the acoustic echo canceller 117 is eliminating the acoustic echo. The waveform 220 indicates that the applied echo cancellation algorithm or filter is not being effective in eliminating the acoustic echo.

Figure 3A:
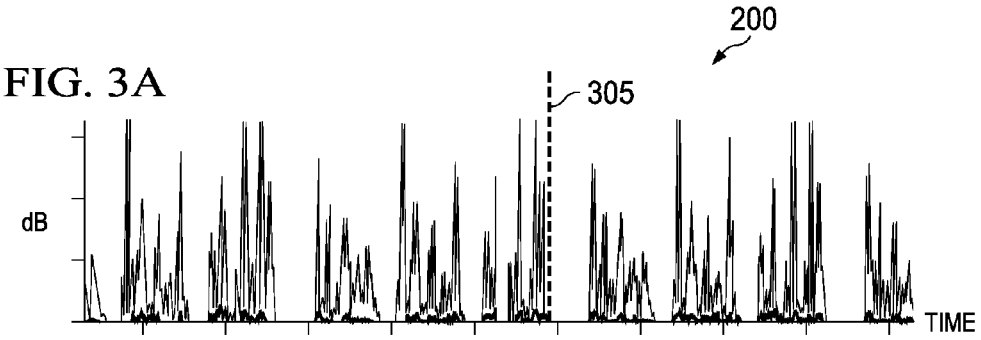
FIGS. 3A, 3B and 3C illustrate another example of waveforms that focuses on a later observation time than FIGS. 2A through 2C.
Figure 3B:
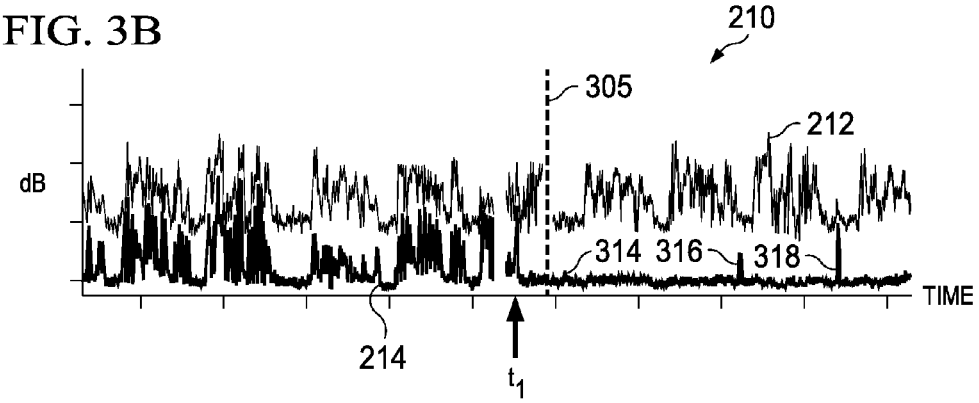
Figure 3C:
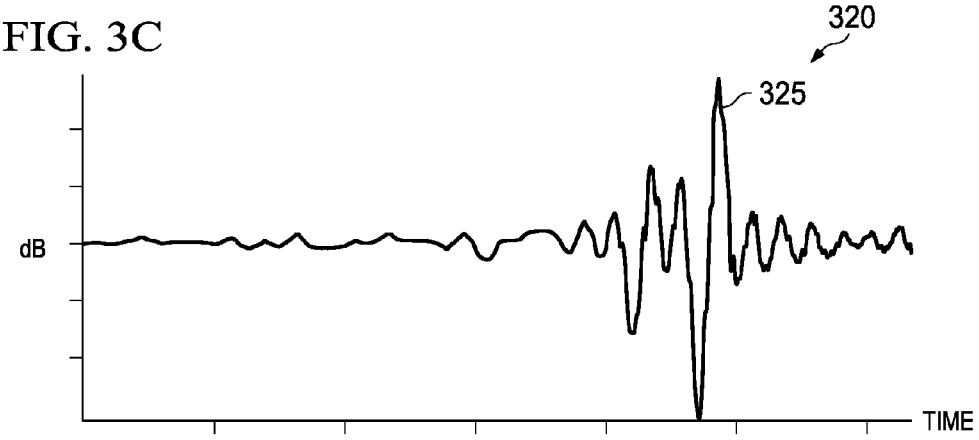

FIGS. 3A, 3B and 3C illustrate another example of waveforms, generally designated 300, 310, 320 that focuses on a later observation time than FIGS. 2A through 2C. Here, an observation time 305 corresponds to an updated echo cancellation setting in the acoustic echo canceller 117. This occurs after the echo cancellation filter setting or algorithm in the acoustic echo canceller is modified at time $t_1$. Here, this updated echo cancellation filter or algorithm setting provides an acceptable degree of echo cancellation.

The waveforms of FIGS. 3A and 3B are the same as those shown in FIGS. 2A and 2B as waveforms 200, 210. At the echo cancellation observation time 305, it may be seen that the first component waveform 212 indicates that an acoustic echo energy applied to the acoustic echo canceller 117 is as strong as before.

However, an improved second component waveform 314 representing the output of the acoustic echo canceller 117 indicates that the acoustic echo has substantially been eliminated (e.g., a further analysis indicates that acoustic echo energy has been reduced by 80 dB, in this example). Several background noise spikes (a first spike 316 and a second spike 318) are visible and are reduced to an acceptable level by the audio background noise suppressor 118.

The waveform 320 further indicates how well the updated echo cancellation algorithm in the acoustic echo canceller 117 is eliminating the acoustic echo. The waveform 320 indicates that the applied echo cancellation algorithm or filter is being effective in eliminating the acoustic echo. Here the filter coefficients snapshot shows an echo replica-like shape having one major peak 325 (unlike the corresponding waveform 220) indicating an effective removal of the acoustic echo energy.

Figure 4A:
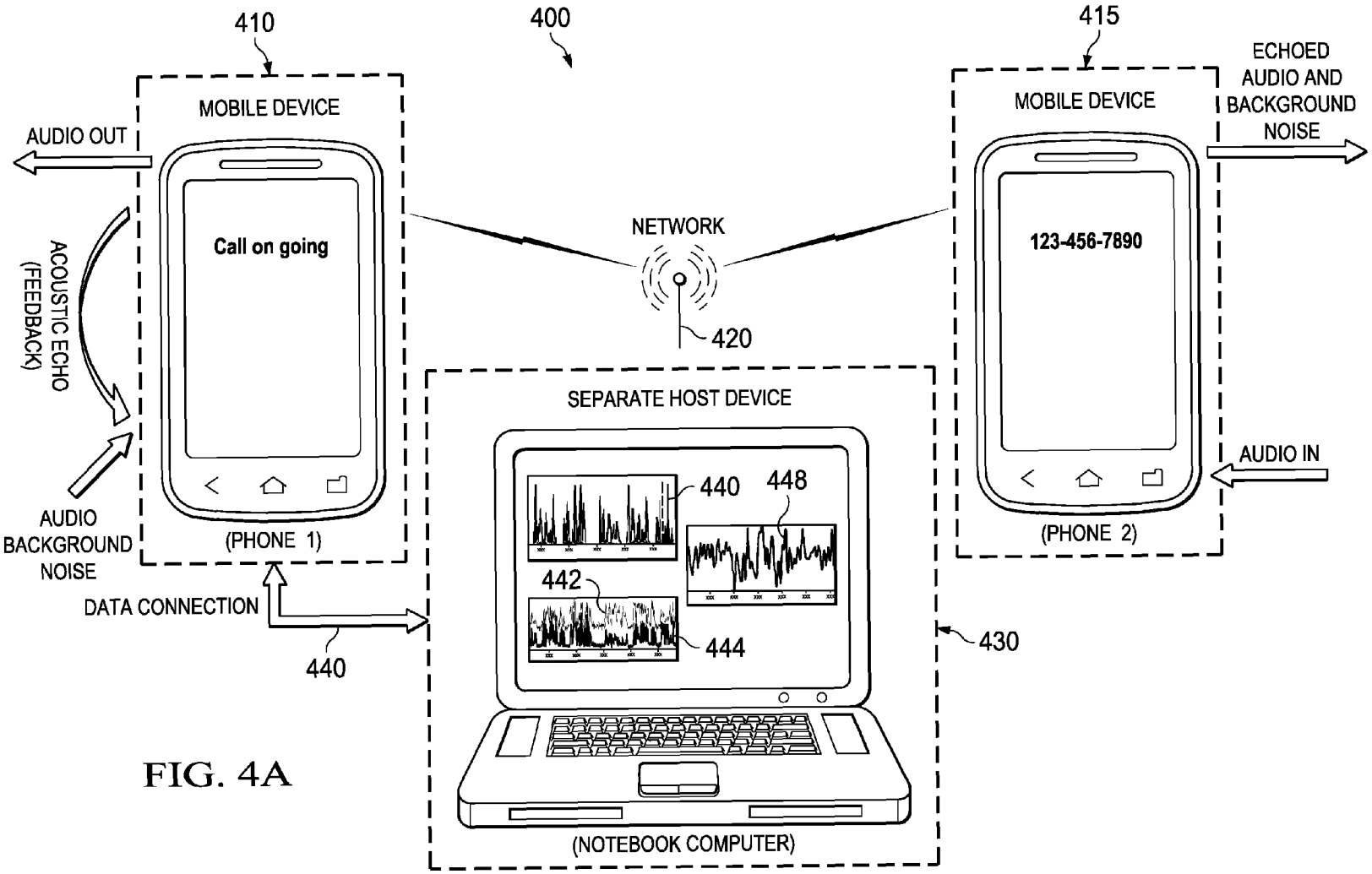
FIGS. 4A and 4B illustrate diagrams of an embodiment of a communications system employing mobile devices and an associated separate host device constructed according to the principles of the present disclosure.
Figure 4B:
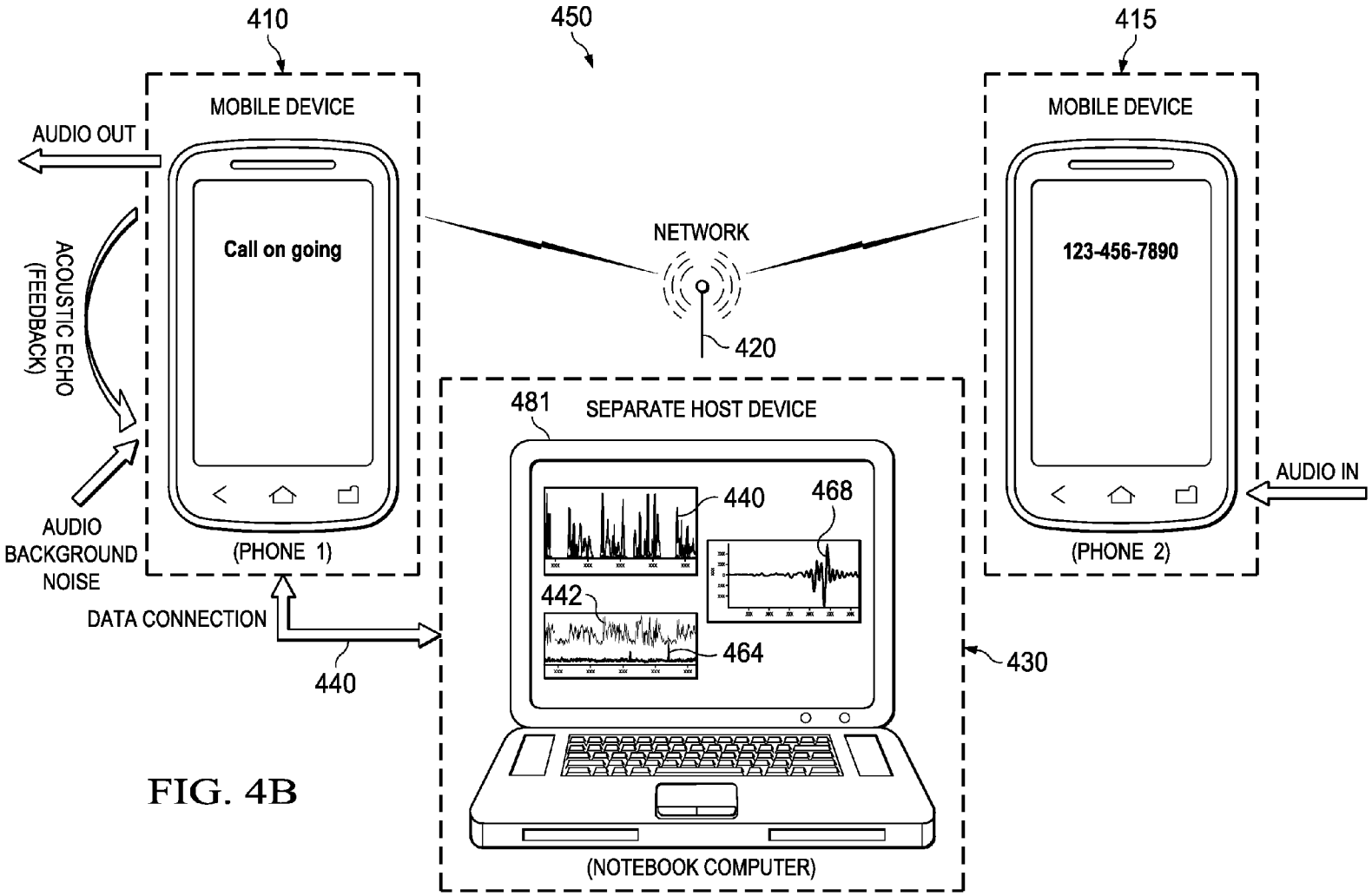

FIGS. 4A and 4B illustrate diagrams of an embodiment of a communications system employing mobile devices and an associated separate host device, generally designated 400, 450, constructed according to the principles of the present disclosure. The communications system 400 includes first and second mobile devices 410, 415 (first and second mobile phones 410, 415) that are coupled together by a network 420. The communications system 400 also includes a separate host device 430 (a notebook computer 430) that is coupled to the first mobile phone 410 through a data connection 440.

An audio input to the second phone 415 is provided to the first phone 410 through the network 420, which then provides a corresponding audio output, as shown. An audio reflective surrounding of the first phone 410 causes an acoustic echo of this audio output, which is fed back to its microphone. This audio echo feedback may be especially severe if the first phone 110 is employed in "speaker" mode. An echoed audio as well as audio background noise associated with the first phone 410 is sent through the network 420 to the second phone 415, as shown, thereby providing echoed and background noise audio interference resulting in a reduction in audio quality for the second phone 415.

In the illustrated embodiment, the first phone 410 does not have acoustic echo cancellation or audio background noise suppression capabilities. The notebook computer 430 is employed to provide these acoustic echo canceller and audio background noise suppressor (i.e., interference reduction unit) capabilities for the first phone 410 using the data connection 440. Additionally, the notebook computer 430 also provides an analysis unit capability for the echo cancellation and background noise suppression as well as displaying their associated waveforms on its computer screen.

In this example, an initial echo cancellation algorithm is inadequate to decrease an audio echo to a degree required by the second phone 415. Waveforms 440, 442, 444, and 448 respectively correspond to the waveforms 200, 212, 214 and 220 shown in FIGS. 2A, 2B and 2C indicating this inadequate echo cancellation condition.

FIG. 4B corresponds to a later observation time where an updated echo cancellation setting (e.g., an updated echo cancellation filter or algorithm setting in the acoustic echo canceller) provides an acceptable degree of echo cancellation as was discussed with respect to FIGS. 3A, 3B and 3C. Here, Waveforms 440, 442, 464, and 468 respectively correspond to the waveforms 200, 212, 314 and 320 shown in FIGS. 3A, 3B and 3C indicating this acceptable degree of echo cancellation.

In the examples of FIGS. 4A and 4B, the data connection 440 is employed by the notebook computer 430 to receive necessary microphone signals from the first phone 410 for echo cancellation and background noise suppression. Correspondingly, echo canceller and background noise suppressor output signals are provided to the first phone 410 from the notebook computer 430 by the data connection 440 for further conditioning and transmission to the second phone 415.

Figure 5A:
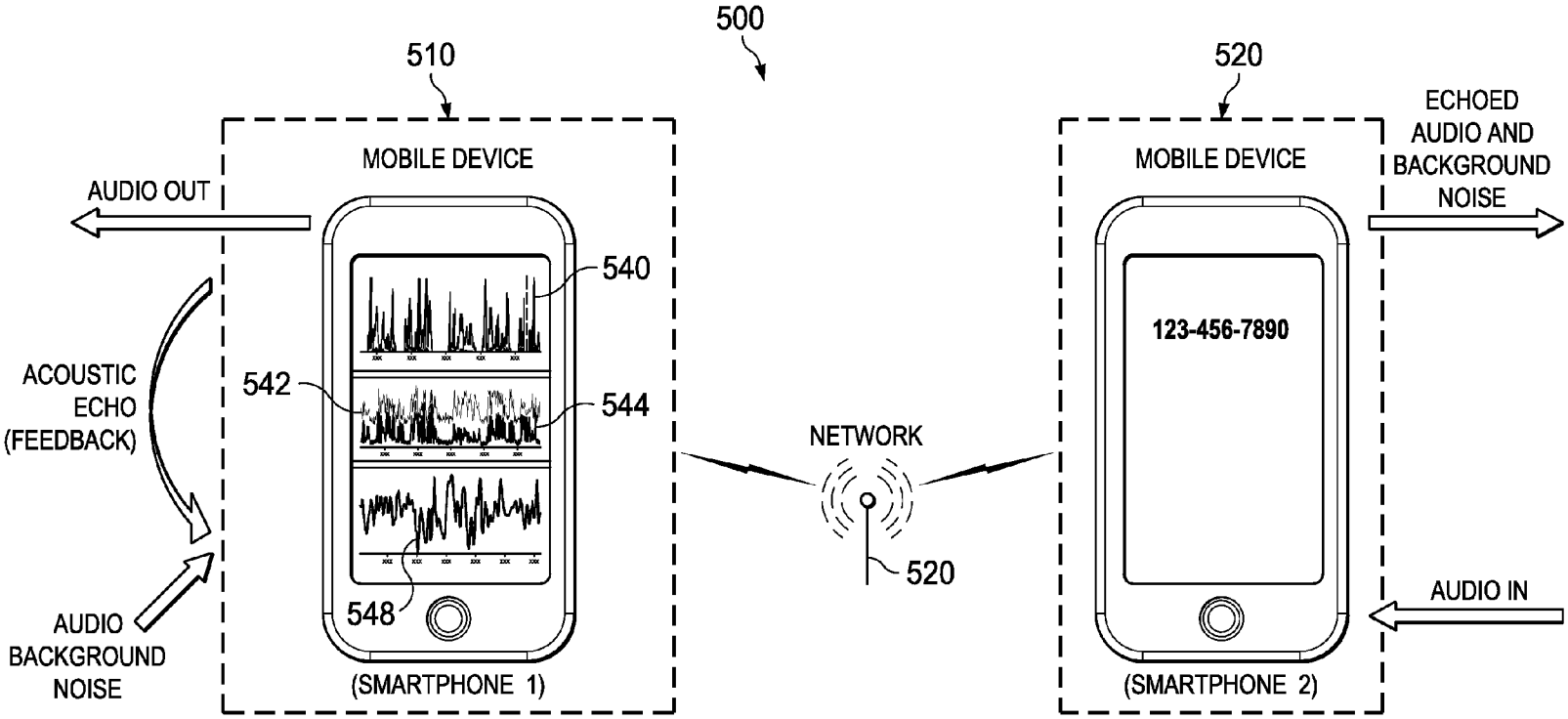
FIGS. 5A and 5B illustrate diagrams of another embodiment of a communications system employing mobile devices constructed according to the principles of the present disclosure.
Figure 5B:
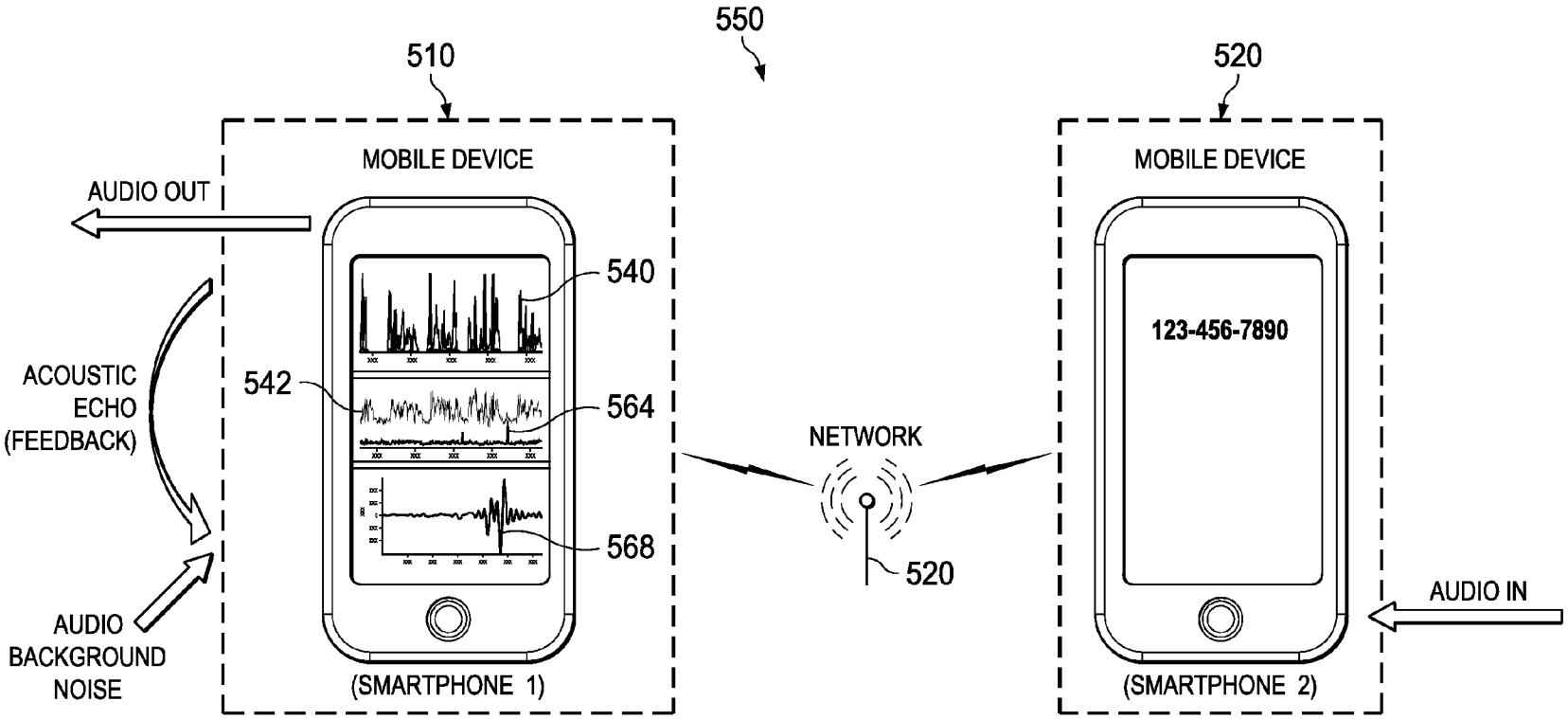

FIGS. 5A and 5B illustrate diagrams of another embodiment of a communications system employing mobile devices, generally designated 500, 550, constructed according to the principles of the present disclosure. The communications system 500 includes first and second mobile devices 510, 515 (first and second smartphones 510, 515) that are coupled together by a network 520. In this embodiment, an echo canceller and a background noise suppressor (i.e., an interference reduction unit) and an analysis unit are contained in the first smartphone 510. Additionally, its mobile device screen is employed to display waveforms associated with echo cancellation, background noise suppression and analysis.

As before, an audio input to the second smartphone 515 is provided to the first smartphone 510 through the network 520, which then provides a corresponding audio output, as shown. Audio reflective surroundings of the first smartphone 510 cause an acoustic echo of this audio output. This is fed back to its microphone causing an echoed audio as well as audio background noise associated with the first phone 510 to be sent through the network 520 to the second phone 515 resulting in a reduction of audio quality for the second phone 515.

As discussed with respect to FIG. 4A, FIG. 5A illustrates an example where an initial echo cancellation algorithm is not adequate to decrease an audio echo to a degree required by the second phone 515. Waveforms 540, 542, 544, and 548 respectively correspond to the waveforms 200, 212, 214 and 220 shown in FIGS. 2A, 2B and 2C indicating this inadequate echo cancellation condition.

FIG. 5B corresponds to a later observation time where an updated echo cancellation setting (e.g., an updated echo cancellation filter or algorithm setting in the acoustic echo canceller) provides an acceptable degree of echo cancellation as was discussed with respect to FIGS. 3A, 3B and 3C. Here, Waveforms 540, 542, 564, and 568 respectively correspond to the waveforms 200, 212, 314 and 320 shown in FIGS. 3A, 3B and 3C indicating this acceptable degree of echo cancellation.

In the examples illustrated in FIGS. 4A, 4B, 5A, and 5B, echo cancellation, background noise suppression and analysis capabilities are entirely contained in either a separate host device or a mobile device. Other embodiments employing the principles of the present disclosure may distribute at least a portion of these capabilities between the separate host device and the mobile device.

Figure 6:
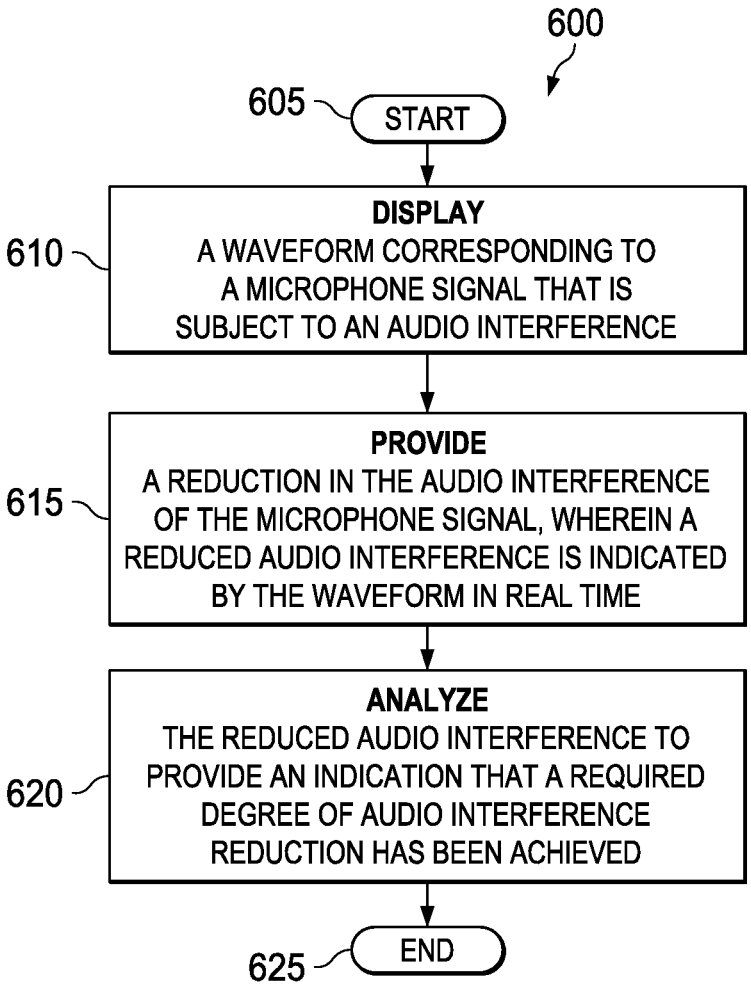
FIG. 6 illustrates a flow diagram of a microphone signal enhancement method carried out according to the principles of the present disclosure.

FIG. 6 illustrates a flow diagram of an embodiment of a microphone signal enhancement method, generally designated 600, carried out according to the principles of the present disclosure. The method 600 starts in a step 605, and in a step 610, a waveform is displayed corresponding to a microphone signal that is subject to an audio interference. A reduction in the audio interference of the microphone signal is provided, wherein a reduced audio interference is indicated by the waveform in real time, in a step 615. Additionally, the reduced audio interference is analyzed to provide an indication that a required degree of audio interference reduction has been achieved, in a step 620.

Generally, providing the reduction in the audio interference includes an acoustic echo cancellation and an audio background noise suppression of the microphone signal having audio interference. In one embodiment, the audio background noise suppression is coupled to the acoustic echo cancellation to reduce audio background noise in real time after achieving a preselected degree of echo cancellation. Additionally, the analysis may employ normalized least mean square (NLMS) coefficients (e.g., in an echo impulse response analysis).

An algorithm controlling echo cancellation or audio background noise suppression may be self-adaptive to achieve a preselected degree of audio interference reduction. Alternately, the algorithm may be user-directed to achieve the preselected degree of audio interference reduction. Correspondingly, user-directed attention (AT) commands may be used to modify parameters of the algorithm. Further, an algorithm may include an adaptive echo delay or noise spectrum estimate, or an estimated echo or noise energy to provide the degree of audio interference reduction.

In another embodiment, at least a portion of providing the reduction in the audio interference is contained in a mobile device or a separate host device. Correspondingly, the mobile device may be a mobile phone, and the separate host device may be a notebook computer. In still another embodiment, logged samples corresponding to the microphone signal are retained in a data logging memory for additional analysis. Correspondingly, the additional analysis may include display, play-back or conversion of an audio file. In a yet further embodiment, a level of microphone signal strength is indicated by the waveform in real time. The method 600 ends in a step 625.

While the method disclosed herein has been described and shown with reference to particular steps performed in a particular order, it will be understood that these steps may be combined, subdivided, or reordered to form an equivalent method without departing from the teachings of the present disclosure. Accordingly, unless specifically indicated herein, the order or the grouping of the steps is not a limitation of the present disclosure.

Those skilled in the art to which this application relates will appreciate that other and further additions, deletions, substitutions or and modifications may be made to the described embodiments.

What is claimed is:

1. An audio enhancement system for a mobile device, comprising:

a display unit configured to exhibit a microphone signal waveform of a microphone of a mobile device having a speaker, a speaker input waveform that is applied to the speaker, and an echo cancelling waveform of an output of an acoustic echo canceller, wherein the microphone signal is subject to audio interference from acoustic echo feedback from the speaker and audio background noise associated with the mobile device; and an interference reduction unit coupled to the microphone signal and configured to provide a reduction in the audio interference, wherein a reduced audio interference is indicated by the echo cancelling waveform in real time, wherein the interference reduction unit includes the acoustic echo canceller coupled to an audio background noise suppressor to provide the reduced audio interference.

2. The system as recited in claim 1 wherein at least a portion of the interference reduction unit is contained in the mobile device or a separate host device having a data connection to the mobile device.

3. The system as recited in claim 2 wherein the mobile device is a mobile phone and the separate host device is a notebook computer.

4. The system as recited in claim 1 further comprising an analyzing unit coupled to the interference reduction unit and configured to analyze the reduced audio interference and indicate achievement of a required degree of audio interference reduction.

5. The system as recited in claim 4 wherein the display unit is further configured to exhibit an echo cancellation signature waveform supplied by the analyzing unit.

6. The system as recited in claim 4 wherein an analysis includes normalized least mean square (NLMS) coefficients.

7. The system as recited in claim 1 wherein the audio background noise suppressor is configured to reduce audio background noise in real time after achieving a preselected degree of echo cancellation.

8. The system as recited in claim 1 wherein logged samples corresponding to the microphone signal are retained in a data logging memory for additional analysis.

9. The system as recited in claim 8 wherein the additional analysis includes display, play-back or conversion of an audio file.

10. The system as recited in claim 1 wherein a microphone signal strength is indicated by the microphone signal waveform in real time.

11. A microphone signal enhancement method, comprising:

displaying a microphone signal waveform corresponding to a microphone signal of a microphone of a mobile device having a speaker, a speaker input waveform that is applied to the speaker, and an echo cancelling waveform of an output of an acoustic echo canceller, wherein the microphone signal is subject to audio interference from acoustic echo feedback from the speaker and audio background noise associated with the mobile device;

providing a reduction in the audio interference of the microphone signal; and indicating a reduced audio interference in real time via the echo cancelling waveform.

12. The method as recited in claim 11 wherein at least a portion of providing the reduction in the audio interference is contained in the mobile device or a separate host device having a data connection to the mobile device.

13. The method as recited in claim 12 wherein the mobile device is a mobile phone and the separate host device is a notebook computer.

14. The method as recited in claim 11 wherein providing the reduction in the audio interference includes an acoustic echo cancellation coupled to an audio background noise suppression to provide the reduced audio interference.

15. The method as recited in claim 14 wherein the audio background noise suppression reduces audio background noise in real time after achieving a preselected degree of echo cancellation.

16. The method as recited in claim 11 further comprising analyzing the reduced audio interference to provide an indication that a required degree of audio interference reduction has been achieved and exhibiting an echo cancellation signature waveform corresponding to the analyzing.

17. The method as recited in claim 16 wherein the analyzing employs normalized least mean square (NLMS) coefficients.

18. The method as recited in claim 11 wherein logged samples corresponding to the microphone signal are retained in a data logging memory for additional analysis.

19. The method as recited in claim 18 wherein the additional analysis includes display, play-back or conversion of an audio file.

20. The method as recited in claim 11 wherein a microphone signal strength level is indicated by the microphone signal waveform in real time.

* * * * *